US008671592B2

(12) United States Patent
Dojan

(10) Patent No.: US 8,671,592 B2
(45) **Date of Patent: *Mar. 18, 2014**

(54) WEAR-RESISTANT OUTSOLE

(75) Inventor: Frederick J. Dojan, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/613,085

(22) Filed: Sep. 13, 2012

(65) Prior Publication Data

US 2013/0000158 A1 Jan. 3, 2013

Related U.S. Application Data

(63) Continuation of application No. 12/847,440, filed on Jul. 30, 2010, now Pat. No. 8,322,049.

(51) Int. Cl.
*A43C 15/02* (2006.01)
*A43B 13/14* (2006.01)

(52) U.S. Cl.
USPC ..... 36/59 C; 36/103

(58) Field of Classification Search
USPC ..... 36/59 C, 103, 59 R, 59 A, 59 B, 25 R, 36/32 R, 30 R, 28; D2/951–953
See application file for complete search history.

(56) References Cited

U.S. PATENT DOCUMENTS

| | | | |
|---|---|---|---|
| 280,791 | A | 7/1883 | Brooks |
| 997,657 | A | 7/1911 | Drake |
| 1,011,110 | A | 12/1911 | Brown |
| 1,355,827 | A | 10/1920 | Finneran |
| 1,545,746 | A | 7/1925 | DeGroot |
| 1,677,013 | A | 7/1928 | Bateman |
| 2,307,727 | A | 1/1943 | Hubbard |
| 2,367,736 | A | 1/1945 | Parsons |
| 2,888,756 | A | 6/1959 | Parson |
| 2,931,110 | A | 4/1960 | Pietrocola |
| 3,629,962 | A | 12/1971 | Brock |
| 4,098,011 | A | 7/1978 | Bowerman |
| 4,160,331 | A | 7/1979 | Bell |
| 4,255,874 | A | 3/1981 | Sironi |

(Continued)

FOREIGN PATENT DOCUMENTS

| | | |
|---|---|---|
| EP | 0159470 | 1/1985 |
| EP | 1264556 A1 | 12/2002 |

(Continued)

OTHER PUBLICATIONS

Communication dated Nov. 7, 2013, with European Search Report in EP11171329.Mar. 1655 dated Oct. 29, 2013.

*Primary Examiner* — Ted Kavanaugh
(74) *Attorney, Agent, or Firm* — Banner & Witcoff, Ltd.

(57) ABSTRACT

An article of footwear may have an outsole with multiple contact zones. Each of those contact zones may include perimeter regions formed from a harder elastomeric material and traction elements formed from a softer elastomeric material. The traction elements within a particular contact zone may be generally planar in shape and aligned in parallel along on orientation direction for that contact zone. When undeformed, the traction elements in a contact zone may extend outward from the outsole beyond the perimeter regions of that same contact zone. In response to a shear force resulting from activity of a shoe wearer, the traction elements may be deformable so as to rest within a volume formed by the perimeter regions.

19 Claims, 9 Drawing Sheets

(56) References Cited

U.S. PATENT DOCUMENTS

| | | | |
|---|---|---|---|
| 4,329,790 | A | 5/1982 | Bell |
| 4,624,062 | A | 11/1986 | Autry |
| 4,702,021 | A | 10/1987 | Cameron |
| 4,866,860 | A | 9/1989 | Blissett et al. |
| 5,077,916 | A | 1/1992 | Beneteau |
| 5,203,097 | A | 4/1993 | Blair |
| 5,862,614 | A | 1/1999 | Koh |
| 5,926,974 | A | 7/1999 | Friton |
| 6,018,889 | A | 2/2000 | Friton |
| 6,021,588 | A | 2/2000 | Alviso |
| D432,294 | S | 10/2000 | Wilson |
| 6,138,386 | A | 10/2000 | Singer et al. |
| 6,698,110 | B1 | 3/2004 | Robbins |
| 6,748,675 | B2 | 6/2004 | Sato |
| 6,904,707 | B2 | 6/2005 | McMullin |
| 6,931,768 | B2 | 8/2005 | Baek |
| 7,124,519 | B2 | 10/2006 | Issler |
| 7,287,343 | B2 | 10/2007 | Healy |
| D554,841 | S | 11/2007 | McClaskie |
| 7,353,770 | B2 | 4/2008 | Sanguinetti |
| D569,087 | S | 5/2008 | Ringholz |
| 7,386,948 | B2 | 6/2008 | Sink |
| 7,418,791 | B2 | 9/2008 | Cole, III |
| 8,322,049 | B2 * | 12/2012 | Dojan ..... 36/59 C |
| 2001/0011429 | A1 | 8/2001 | Peabody |
| 2002/0017038 | A1 | 2/2002 | Umezawa |
| 2002/0116843 | A1 | 8/2002 | Harrison |
| 2003/0115776 | A1 | 6/2003 | Chu |
| 2004/0128860 | A1 | 7/2004 | Smaldone et al. |
| 2006/0053660 | A1 | 3/2006 | Lewton |
| 2007/0017124 | A1 | 1/2007 | Koo et al. |
| 2007/0130801 | A1 | 6/2007 | Wu |
| 2008/0060223 | A1 | 3/2008 | Keating et al. |
| 2008/0148601 | A1 | 6/2008 | Lefgren |
| 2008/0222921 | A1 | 9/2008 | Gerber |
| 2009/0090031 | A1 | 4/2009 | Jung |
| 2009/0293314 | A1 | 12/2009 | Dekovic et al. |
| 2009/0293315 | A1 | 12/2009 | Auger et al. |
| 2010/0011622 | A1 | 1/2010 | Abadjian |
| 2010/0281714 | A1 | 11/2010 | Carboy et al. |

FOREIGN PATENT DOCUMENTS

| | | | |
|---|---|---|---|
| EP | 1354527 | A1 | 10/2003 |
| JP | H04279102 | | 10/1992 |
| JP | 5329005 | | 12/1993 |
| JP | 2008093016 | A | 4/2008 |

* cited by examiner

WEAR-RESISTANT OUTSOLE

CROSS-REFERENCE TO RELATED APPLICATION

This application is a continuation of and claims priority to U.S. patent application Ser. No. 12/847,440, titled "Wear-Resistant Outsole" and filed Jul. 30, 2010 (now U.S. Pat. No. 8,322,049). U.S. patent application Ser. No. 12/847,440, in its entirety, is incorporated by reference herein.

BACKGROUND

"Traction" is a general term used to describe the ability of a shoe outsole to resist sliding motion over a surface contacted by that outsole. Traction is particularly important in athletic footwear. For example, basketball, tennis and numerous other activities often require an athlete to engage in rapid sideways motion. A secure, non-sliding contact between such an athlete's footwear and a playing surface is thus important. Without secure, non-sliding contact, the athlete's foot can slip. Such slipping will often affect the quality of the athlete's performance, and can even cause injury.

Footwear for some sports can employ cleats, spikes or other surface-penetrating mechanisms to increase traction. For many activities, however, friction between an outsole and a playing surface is the only mechanism that prevents a shoe from slipping. In such cases, increasing traction requires increasing the friction between an outsole and the playing surface(s) on which a shoe with that outsole will be used. Typically, outsoles for athletic footwear are formed from synthetic rubber and/or some other elastomeric material. Softer elastomeric materials generally have higher frictional coefficients and provide better traction, but tend to wear quickly on concrete and other rough surfaces. Harder elastomeric materials tend to have lower frictional coefficients and provide less traction, but tend to be more durable.

Certain types of playing surfaces (e.g., indoor hardwood floors) may be relatively smooth and non-abrasive. Because these surfaces impart less wear on an outsole, softer outsole materials may wear less quickly when used on these surfaces. If a shoe will only be used on hardwood or other smooth surface, it may be practical to use softer outsole materials to increase traction. Other types of playing surfaces (e.g., concrete) are more abrasive and can result in more rapid outsole wear. If a shoe will be worn on concrete or another abrasive surface, a harder outsole material with poorer traction may be preferable to a softer outsole material that would wear too quickly. For many persons who may play a particular sport on both types of surfaces, however, owning two pairs of athletic shoes may be inconvenient and/or economically impractical.

SUMMARY

This Summary is provided to introduce a selection of concepts in a simplified form that are further described below in the Detailed Description. This Summary is not intended to identify key or essential features of the invention.

In some embodiments, an article of footwear has an outsole that includes multiple contact zones. Each of those contact zones includes perimeter regions formed from a harder elastomeric material, as well as multiple traction elements formed from a softer elastomeric material. The traction elements within a particular contact zone may be generally planar in shape and aligned in parallel along on orientation direction for that contact zone. When in an undeformed state, the traction elements in a contact zone may extend outward from the outsole beyond the perimeter regions of that same contact zone. In response to a shear force resulting from activity of a shoe wearer, the traction elements are deformable so as to rest within a volume formed by the perimeter regions.

The size and shape of contact zones may vary. Some contact zones may include more traction elements than other zones, and the sizes and shapes of traction elements within a zone and/or of different zones may vary. The traction elements of one or more zones may be aligned in an orientation direction that is different from the orientation directions associated with other zones.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
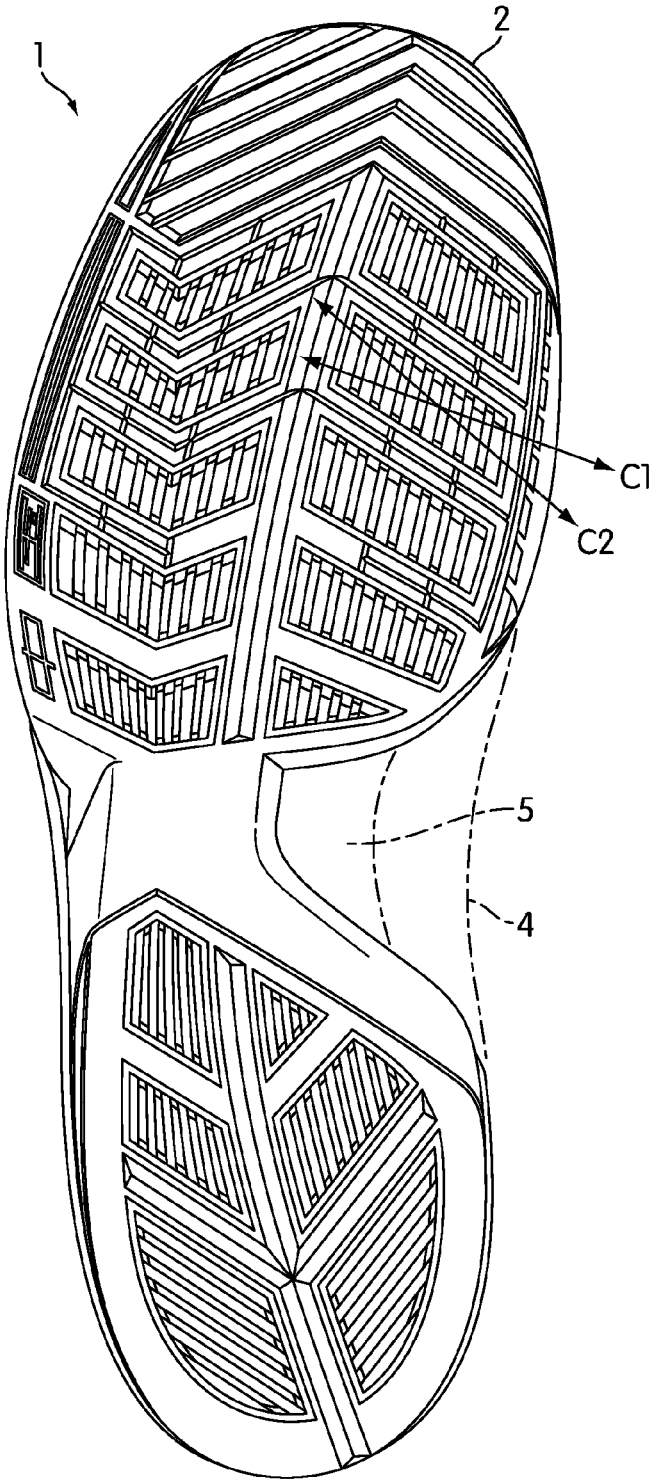
FIG. 1 is a bottom plan view of a basketball shoe showing an outsole according to some embodiments.
Figure 2A:
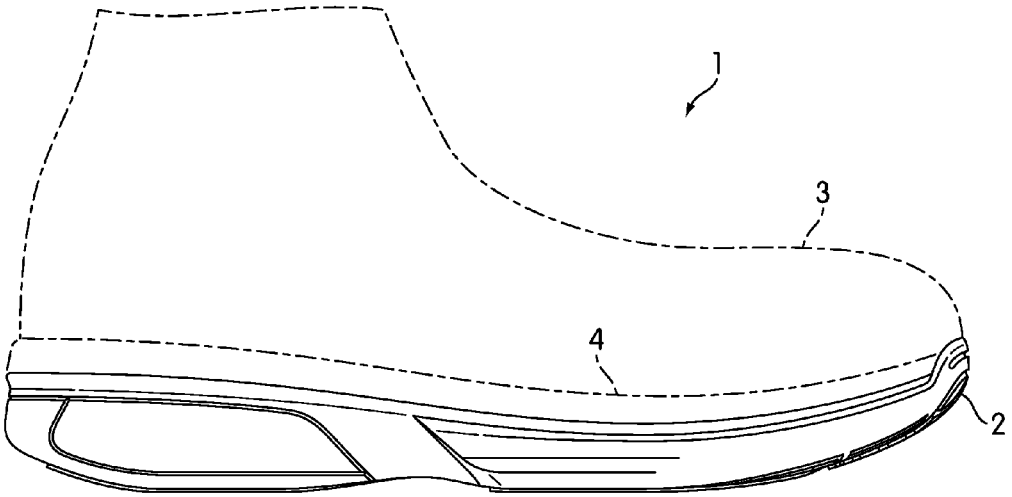
FIGS. 2A and 2B are respective lateral and medial side views of the shoe of FIG. 1.
Figure 2B:
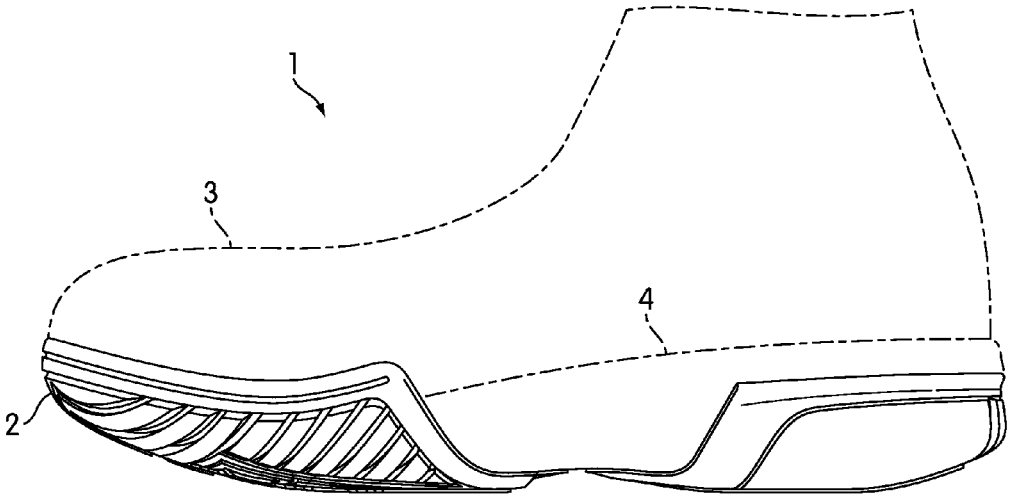

FIG. 1 is a bottom plan view of a basketball shoe 1 showing an outsole 2 according to some embodiments. FIGS. 2A and 2B are respective lateral and medial side views of shoe 1. In the embodiment of shoe 1, outsole 2 is bonded to a midsole 4, with midsole 4 bonded to an upper 3. In some regions (e.g., in the medial toe region as seen in FIG. 2B), outsole 2 may also be directly bonded to upper 3. As seen in FIG. 1, a support element 5 may be interposed between outsole 2 and midsole 4 along a portion of the length of shoe 1. Although not shown in FIGS. 1-2B, a gas- or liquid-filled cushioning pad can be included between outsole 2 and midsole 4 in the forefoot and/or heel regions.

Midsole 4 may be formed from, e.g., a compressed ethylene vinyl acetate foam (Phylon), polyurethanes, TPU or other materials. Support plate 5 may be formed from, e.g., composites of carbon and/or glass fibers bound in a polymer resin. Upper 3 can be formed from materials conventionally used for athletic footwear uppers, from bonded mesh composite materials such as described in commonly-owned U.S. patent application Ser. No. 12/603,494 (titled "Composite Shoe Upper and Method of Making Same," filed Oct. 21, 2009, and incorporated by reference herein in its entirety), or from other materials. Materials and additional details of outsole 2 are described below.

Outsole 2 and outsoles according to other embodiments can be attached to any of various types of upper, and further details of upper 3 are thus not pertinent to the discussion herein. Accordingly, upper 3 is shown as a simple broken-line silhouette in FIGS. 2A and 2B. Similarly, outsole 2 and outsoles according to other embodiments can be used with different types of midsoles and/or support plates. Indeed, some embodiments may include footwear in which a separate midsole and/or a support plate is omitted. Because further details of midsole 4 and support plate 5 are not pertinent to the discussion herein, those elements are likewise shown in broken lines.

Although shoe 1 is a basketball shoe, other embodiments include footwear intended for use in other athletic and non-athletic activities.

Certain regions of outsole 2 and of outsoles according to other embodiments may be described by reference to the anatomical structures of a human foot wearing a shoe having that outsole, when that shoe is properly sized for that foot. One or more of the below-defined regions may overlap. A "forefoot" region will generally lie under the metatarsal and phalangeal bones of the wearer's foot and will extend beyond the wearer's toes to the frontmost portion of the shoe. A "midfoot" region will generally lie under the cuboid, navicular, medial cuneiform, intermediate cuneiform and lateral cuneiform bones of the wearer's foot. A "hindfoot" region extends from the midfoot region to the rearmost portion of the shoe and lies under the wearer heel. As used herein, an "outward" direction is a direction away from the sole of a wearer's foot. A "forward" direction is a direction toward the frontmost portion of outsole 2. A "rearward" direction is a direction toward the rearmost portion of outsole 2. A "transverse" direction is a direction across the exposed outer surface of outsole 2, and can be forward, rearward, medial, lateral, or some direction with both forward (or rearward) and medial (or lateral) components.

So as to increase traction while also increasing durability, each of various embodiments of outsole 2 is formed from a combination of at least two elastomeric materials having different ranges of hardness values. For convenience, two such materials used for an arbitrary embodiment of outsole 2 will be referred to as "the hard elastomeric material" and as "the soft elastomeric material" when describing outsole 2. In any particular embodiment of outsole 2, the hard elastomeric material is generally harder than the soft elastomeric material. As known in the art, hardness of an elastomeric material can be quantified in several ways. Throughout this specification, description of one material being harder or softer than another material shall refer to the relative hardnesses of those materials when quantified according to the same method.

In some embodiments, various types of synthetic and/or natural rubber compounds can be used for hard elastomeric material portions of outsole 2. Examples of such compounds include durable rubber compounds (DRC), diene rubber compounds and rubber compounds such as are described in commonly-owned U.S. Pat. No. 7,211,611, which patent is incorporated by reference herein in its entirety. Table 1 provides physical parameters for hard elastomeric materials according to some embodiments.

TABLE 1

| Material | (1a) | (1b) | (1c) |
|---|---|---|---|
| Hardness range (Shore A durometer) | 71-77 | 68-74 | 68-72 |
| Tensile strength (psi) | 100-110 | 140 | 100 |

TABLE 1-continued

| Material | (1a) | (1b) | (1c) |
|---|---|---|---|
| Elongation at rupture (%) | 400 | 400 | 450 |
| Tensile modulus, 300% (psi) | 70 | 70 | 60 |
| Tear resistance (lbs./in.) | 50 | 60 | 53 |
| Abrasion resistance (Akron abrasion test method) | 0.07 | 0.05 | 0.08 |
| Specific gravity range | 1.13-1.17 | 1.12-1.16 | 1.12-1.16 |

Similarly, various types of synthetic and/or natural rubber compounds can be used for soft elastomeric material portions of outsole 2. Examples of such compounds include butyl rubber compounds and rubber compounds such as are described in the aforementioned U.S. Pat. No. 7,211,611. Table 2 provides physical parameters for soft elastomeric materials according to some embodiments.

TABLE 2

| Material | (2a) | (2b) |
|---|---|---|
| Hardness range (Shore A durometer) | 52-58 | 42-54 |
| Tensile strength (psi) | 70 | 70 |
| Elongation at rupture (%) | 400 | 300 |
| Tensile modulus, 300% (psi) | 35 | 30 |
| Tear resistance (lbs./in.) | 40 | 25 |
| Abrasion resistance (Akron abrasion test method) | 0.45 | 0.5 |
| Specific gravity range | 1.04-1.08 | 1.10-1.13 |

Each possible combination of a material from Table 1 and a material from Table 2 can be used in at least one separate embodiment of outsole 2. For example, in one embodiment the hard elastomeric material portions of outsole 2 are formed from material (1*a*) and the soft elastomeric material portions are formed from material (2*a*), in another embodiment the hard elastomeric material portions are formed from material (1*a*) and the soft elastomeric material portions are formed from material (2*b*), in yet another embodiment the hard elastomeric material portions are formed from material (1*b*) and the soft elastomeric material portions are formed from material (2*a*), etc. Each possible combination of a material from Table 1 and a material from Table 2 can also be used in outsoles that differ from outsole 2. Examples of ways in which outsoles of other embodiments may differ from outsole 2 are described below. Moreover, the materials described in Tables 1 and 2 are only examples of elastomeric materials than can be used in an outsole such as outsole 2 or an outsole according to other embodiments. Numerous other materials can also (or alternatively) be used. For example, soft elasotemeric materials used in some embodiments may have Shore A durometer hardness values between 35 and 60. Hard elastomeric materials used in some embodiments may have Shore A durometer hardness values between 55 and 75 or between 60 and 95.

Although outsole 2 is formed from two elastomeric materials, other embodiments may include outsoles formed from more than two elastomeric materials. For example, an outsole according to another embodiment could include some portions formed from a harder first elastomeric material, other portions formed from a less hard second elastomeric material, still other portions formed by an even less hard third elastomeric material, etc.

Figure 3:
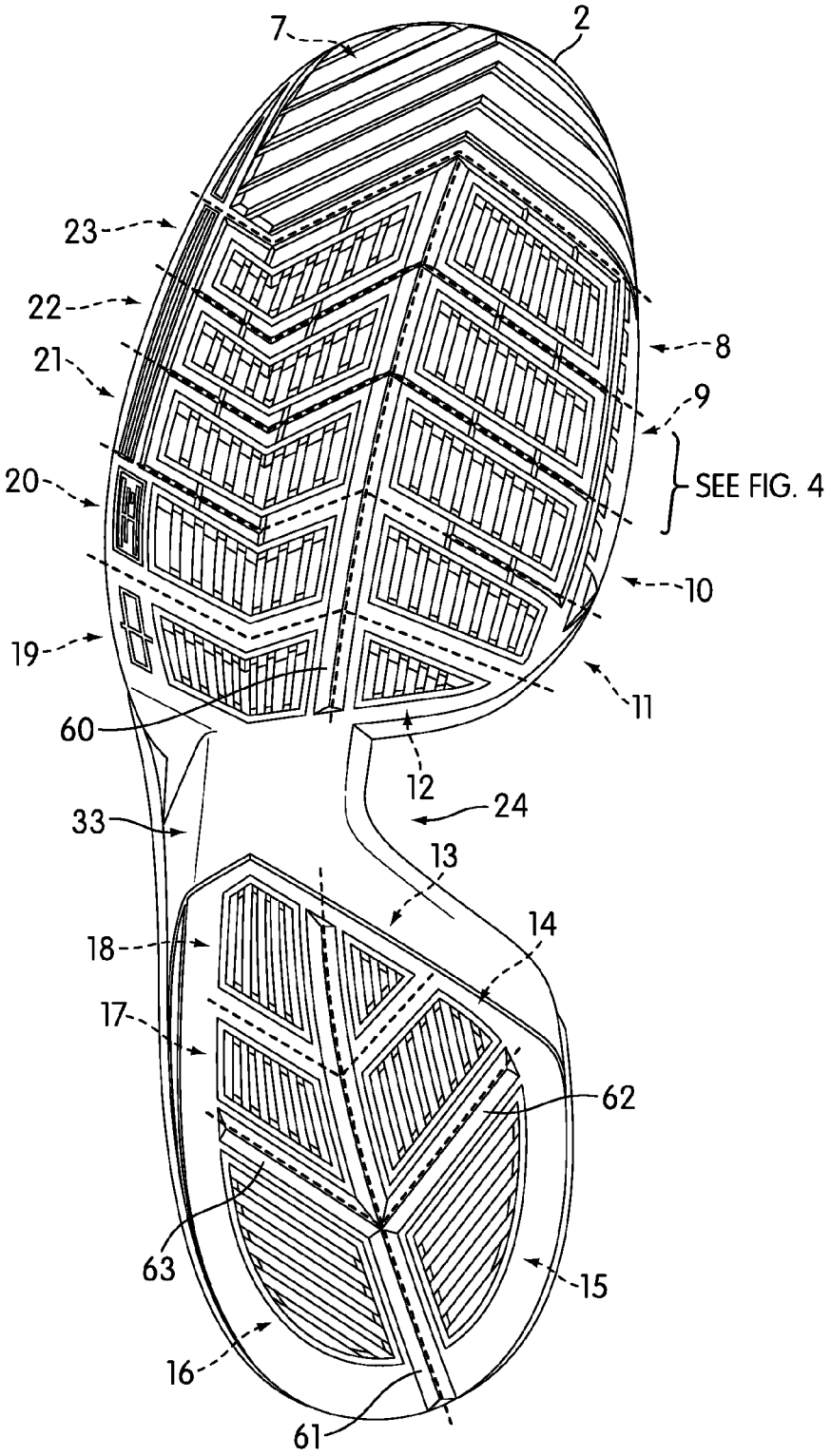
FIG. 3 is a bottom plan view of the outsole of the basketball shoe of FIG. 1, and with various zones marked for reference purposes.

As can be appreciated, numerous zones of outsole 2 will contact a playing surface when a wearer of shoe 1 participates in a basketball game or other activity. To aid further explanation, FIG. 3 is a bottom plan view of outsole 2 that identifies various contact zones with broken line boundaries. For example, contact zone 7 generally lies under the toes of a shoe 1 wearer. Contact zones 8-12 and 19-23 generally lie under forefoot and midfoot regions of a shoe 1 wearer, and extend from contact zone 7 to just forward of arch region 24. Contact zones 13-18 generally lie under the hindfoot regions of a wearer and extend rearward from arch region 24. Additional details of contact zones 7-23 are provided below. As also explained in further detail herein, the number, size, shape and arrangement of contact zones shown in FIG. 3 merely represent one exemplary embodiment. In other embodiments, the size, number, shape and arrangement of contact zones may vary considerably.

Outsole 2 has a main body 33 formed from the hard elastomeric material. Contact zone 7 includes a relatively coarse herringbone tread pattern formed in main body 33, and is a single material contact zone. In particular, contact zone 7 only contains the hard elastomeric material on its exposed surfaces. When shoe 1 is worn during an athletic activity, portions of contact zone 7 coming into contact with a playing surface all have hardness values in the hardness value range associated with the hard elastomeric material. Contact zones 8-23 are dual material contact zones. In particular, each of zones 8-23 includes both hard elastomeric material elements and soft elastomeric material elements. When shoe 1 is worn during an athletic activity, exposed surfaces of hard and soft elastomeric material elements in each of zones 8-23 can contact the playing surface.

In the embodiment of outsole 2, each of zones 8-23 includes a cavity formed in main body 33. Each cavity is surrounded by a perimeter regions of the hard elastomeric material of main body 33 and includes a soft elastomeric material insert. Each of those inserts includes a plurality of traction elements having relatively short lengths, and with traction elements of a particular insert being parallel to one another. Each of the traction elements within a particular contact zone are substantially more bendable in directions parallel to a primary traction axis and substantially less bendable in directions parallel to a secondary traction axis.

Figure 4:
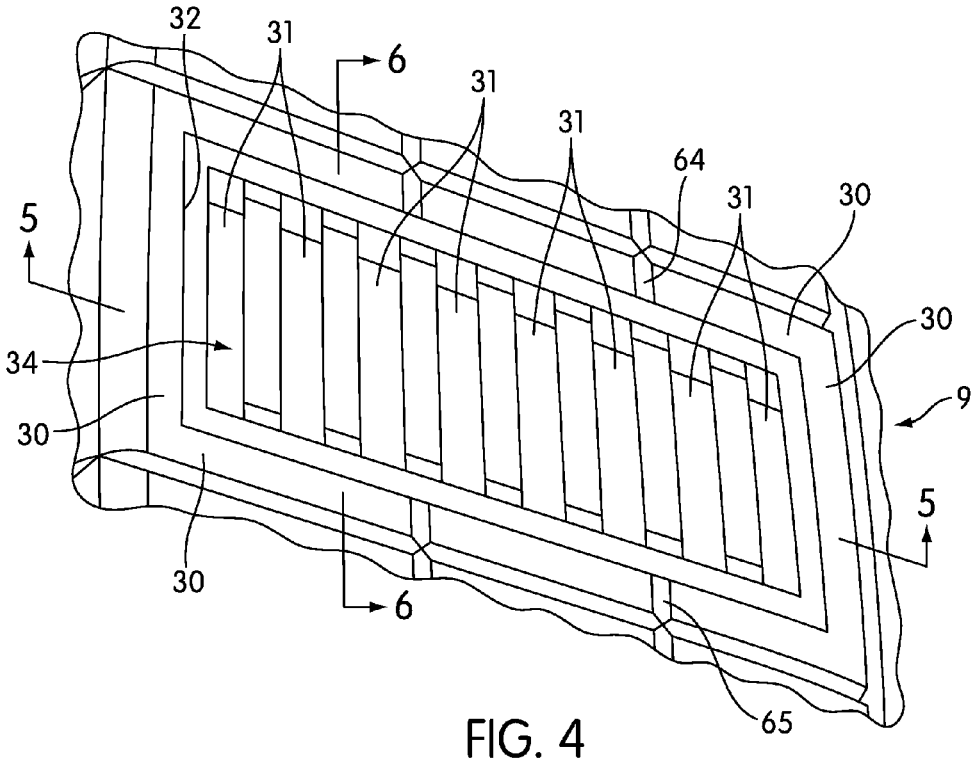
FIG. 4 is an enlarged view of a contact zone of the outsole in FIG. 3.
Figure 5:
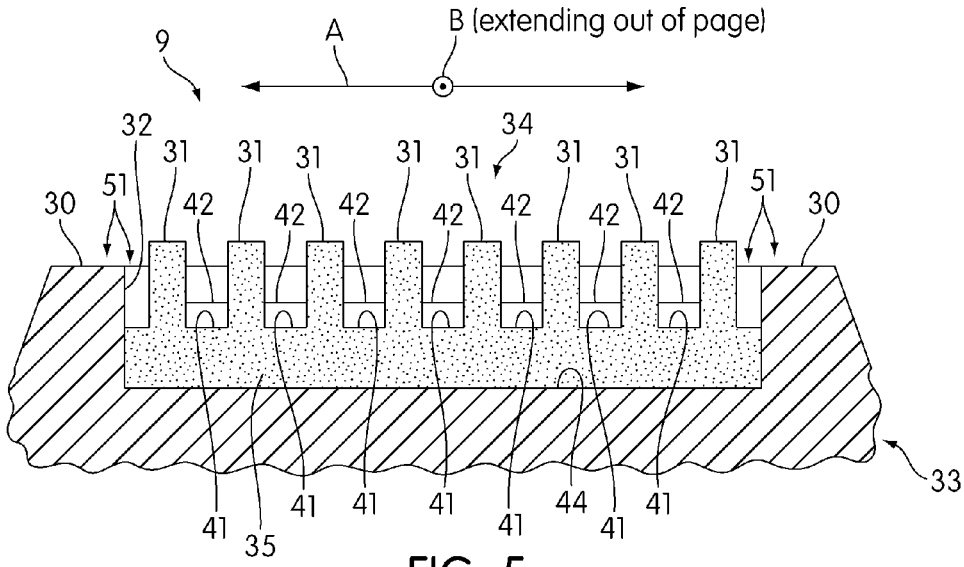
FIGS. 5 and 6 are cross-sectional views taken from the locations shown in FIG. 4.

FIG. 4 is an enlarged view of a portion of outsole 2 that includes contact zone 9. FIG. 5 is a cross-sectional view of contact zone 9 taken from the location shown in FIG. 4. In FIG. 5 and subsequent drawings, the hard elastomeric material is represented with cross-hatching and the soft elastomeric material is represented by stippling. Although various differences between contact zones are apparent from FIG. 3 and will be discussed below, many features of contact zone 9 may be the same as (or very similar to) corresponding features of other contact zones.

Contact zone 9 includes a cavity 32 formed in the hard elastomeric material of main body 33. Perimeter regions 30 form walls surrounding cavity 32 and are integral elements of main body 33. Each of contact zones 8 and 10-23 similarly includes a cavity formed in main body 33. The shapes and transverse dimensions of those cavities may vary significantly, but each of those cavities may have a depth similar to that of cavity 32. Each of those cavities is similarly surrounded by perimeter regions that are integral elements of main body 33 and that form cavity walls.

As also shown in FIG. 5, soft elastomeric insert 34 is attached to main body 33 and rests within cavity 32. A base 35 of insert 34 is bonded to the inward surface 44 of cavity 32 and to adjacent portions of the cavity 32 interior walls. Insert 34 includes eight integral traction elements 31 extending outward from cavity 32. Each of traction elements 31 is separated from other tractions elements 31 of insert 34. Each of the separation distances between elements 31 may, but need not, be the same. Traction elements 31 at the ends of insert 34 are also separated from the interior faces of cavity 32 walls. Both end separation distances for zone 9 may, but need not be, the same. As explained below, each of traction elements 31 is substantially more bendable in directions parallel to primary traction axis A, and substantially less bendable in directions parallel to a secondary traction axis B.

Each of contact zones 8 and 10-23 similarly includes a soft elastomeric material insert. The inserts of other contact zones may vary in size, shape and transverse dimensions, and may also vary in the orientation, length and number of traction elements. However, each of the other inserts may include a base similar to base 35 that fills (and is bonded) to an inward portion of a contact zone cavity in a manner similar to that in which base 35 fills and is bonded to the inward portion of cavity 32. Each of those inserts includes a plurality of parallel traction elements that are substantially more bendable in directions parallel to a primary traction axis and substantially less bendable in directions parallel to a secondary traction axis, although the primary axes of a particular one of those inserts may be non-parallel to the primary axes of another one of the inserts. Other aspects of the traction elements in contact zones 8 and 10-23 that may be similar to aspects of elements 31 of zone 9 are described below.

Figure 6:
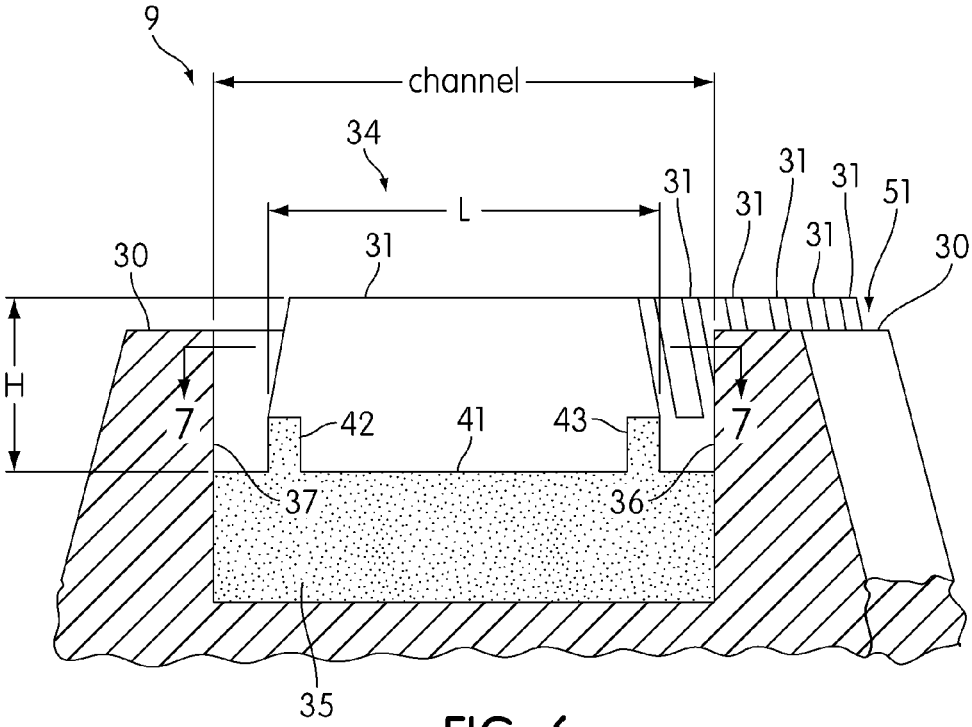

FIG. 6 is a further enlarged cross-sectional view of contact zone 9 taken from the location shown in FIG. 4. Two of the perimeter regions 30 bounding cavity 32 form a channel that is substantially spanned by each traction element 31. In particular, each traction element 31 of insert 34 has a first end that is separated from a first interior side wall 37 of the channel and a second end that is separated from a second interior side wall 36 of the channel. As seen by comparing FIGS. 5 and 6, insert 34 also includes a series of pockets 41 formed at the bases of traction elements 31. As a result, and as seen in FIG. 6, webs 42 and 43 connect edges of elements 31.

Figure 7:
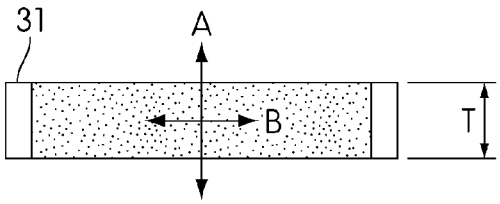
FIG. 7 is a cross-sectional view taken from the location shown in FIG. 6.

As also seen in FIG. 6, a substantial part of each traction element 31 includes a trapezoidally-shaped portion that extends outward from a portion joined by webs 42 and 43. In other embodiments, traction elements in some or all zones may have trapezoidal portions that are not symmetric (e.g., one of the sides of a traction element may be straight, or the sides may otherwise have a different angles relative to the top edge of the traction element), or that may be simple right rectangles, or that may have other shapes. Each of elements 31 has an overall height H. Each traction element 31 also extends outward beyond the exposed surfaces 51 of perimeter regions 30 by a small distance. Each traction element 31 has an overall length L. FIG. 7 is a cross section of traction element 31 taken from the location shown in FIG. 6, and shows the thickness T of element 31.

In some exemplary embodiments, each traction element 31 in outsole 2 may have a height H of approximately 3 mm and a thickness T of approximately 2.5 mm, and each traction element 31 in one of zones 8-11 or 19-23 may have a length L between 9 and 15 mm. Some traction elements in zones 12 and 13 may have a length L less than 9 mm, and some traction elements in zones 14-18 may have a length L that is greater than 15 mm. Values provided herein for height H, thickness T and length L are merely some examples of such dimensions in some embodiments. One or more of these dimensions may vary beyond these exemplary values in some embodiments. In some embodiments, most (i.e., at least 50%) of the traction elements in an outsole may have a thickness T of at least 1 mm and a length L less than 25 mm. In further embodiments, a substantial portions (e.g., approximately 75% or more) may have a thickness T of at least 1 mm and a length L less than 25 mm.

As shown in FIGS. 6 and 7, traction element 31 has a relatively thin rectangular cross section in the trapezoidal portion extending above webs 42 and 42, with that trapezoidal portion forming a planar cantilever beam. This cross section allows element 31 to bend relatively easily in directions generally parallel to a primary traction axis A. Conversely, and at least for the traction elements of insert 34, there is more bending resistance in directions generally parallel to a secondary traction axis B. Other embodiments may include traction elements that have different cross sections, but that can similarly bend relatively easily in one direction and provide more bending resistance in a different direction.

As previously indicated, each of zones 8 and 10-23 may be similar to zone 9 in many respects. Each of zones 8 and 10-23 may include a cavity formed in outsole main body 33. Each of those cavities may have a depth similar to that of cavity 32 (FIG. 5) and be surrounded by perimeter regions of the hard elastomeric material of main body 33. A soft elastomeric material insert may be bonded within each of those cavities, with each of those inserts resting within its corresponding cavity in a manner similar to that of insert 34 in cavity 32. Each of those inserts may be similar in structure to insert 32 and includes parallel traction elements having a generally trapezoidal shape with pockets (similar to pockets 41 of FIGS. 5 and 6) at their bases. As to each insert in zones 8 and 10-23 and the perimeter regions surrounding the cavity in which that insert is located, the traction elements of that insert may extend outward beyond the exposed surfaces of corresponding perimeter regions in a manner similar to that shown in FIG. 6.

As also indicated above, various contact zones differ in some respects. The shapes and overall sizes of the zones vary. For example, the cavities and inserts of zones 19-23 are chevron-shaped. The lengths of the traction elements also vary. Many of the traction elements in zones 15, 16 and 18, for example, may have a length L that is substantially longer than a length L for traction elements in zone 9 or in other zones. In some cases, the lengths of traction elements within a single zone may vary significantly. The orientation of the traction elements may also vary between zones. This can be seen, e.g., by comparing zones 15 and 16 or by comparing zone 15 or zone 16 with any of zones 8-12 or 19-23.

In various embodiments of outsole 2, and as shown in FIG. 3, traction elements in the forefoot and midfoot regions may generally be oriented so as to be roughly parallel to the length of the fore- and midfoot regions. In this manner, and as described in more detail below, the primary traction axis A (see FIG. 7) for those traction elements is approximately parallel to the direction of sideways shear forces imparted on outsole 2 by a playing surface during sideways movements of shoe wearer. In a similar manner, traction elements in the hindfoot region zones are aligned so that the primary axes A of elements in those zones are parallel to directions of expected forces on the outsole during certain other movements by a shoe wearer.

As also shown in FIG. 3, a front flex groove 60 is located approximately on the midline of outsole 2 and separates medial zones 8-12 from lateral zones 19-23. The chevrons of zones 19-23 are generally in alignment, which alignment allows flexing of the lateral side outsole but helps to resist outsole instability. A rear flex groove 61 separates zones 13-15 from zones 16 through 18, with branching flex grooves 62 and 63 respectively extending medially and laterally. Narrower flex grooves separate other portions of outsole 2. Specifically, narrow flex grooves separate zone 7 from zone 8, zone 8 from zone 9, a portion of zone 9 from a portion of zone 10, a portion of zone 20 from a portion of zone 21, zone 21 from zone 22, zone 22 from zone 23, and zone 23 from zone 7. In other cases, the perimeter regions of adjacent zones are continuous and there is no separating flex groove (see, e.g., zones 11 and 12, zones 19 and 20, zones 13 and 14, zones 17 and 18). Other embodiments may have different configurations of flex grooves, or may lack flex grooves.

Inclusion of soft elastomeric material traction elements can increase the traction of outsole 2 beyond what might be available if only the hard elastomeric material were used. Conversely, the ability of such traction elements to significantly deform within hard elastomeric perimeter regions can increase the durability of those traction elements. This is illustrated in FIG. 8, another view of contact zone 9 from the same cross-sectional plane used for FIG. 5, but inverted by 180° to show outsole 2 on a playing surface S.

Figure 8:
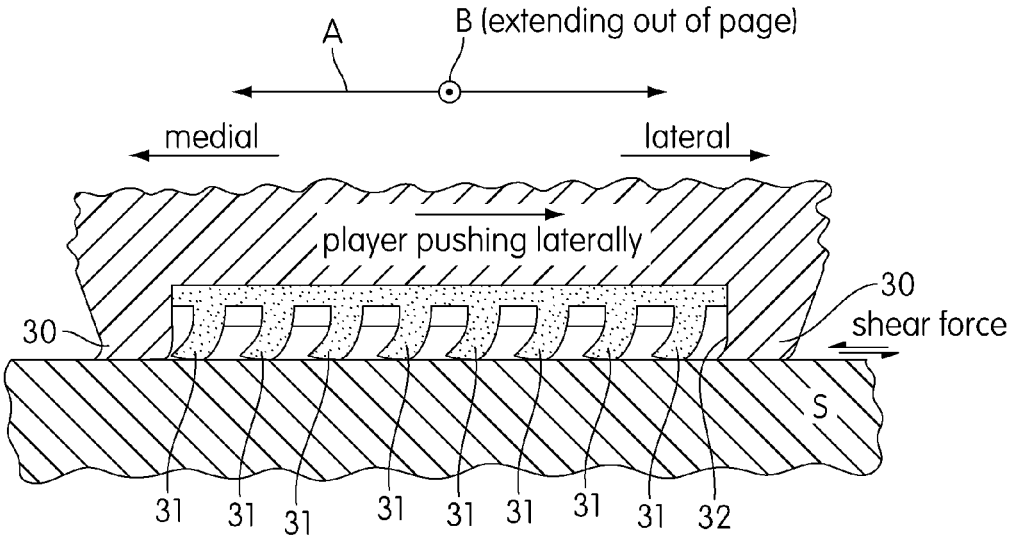
FIG. 8 is a cross-sectional view showing deformation of a portion of the outsole from FIG. 1 during athletic activity.

FIG. 8 shows contact zone 9 in contact with surface S while a wearer of shoe 1 is pushing to the lateral side of shoe 1 in a direction parallel to the primary traction axes A of traction elements 31. Such a condition is a typical usage scenario for a basketball shoe. Although FIG. 8 shows surface S using cross-hatching similar to that used for hard elastomeric material, surface S could be hardwood, concrete or another type of surface. As shown in FIG. 8, the perimeter regions 30 deform slightly in response to the shear force on outsole 2 by surface S. Because traction elements 31 are formed from the soft elastomeric material and have cross sections that facilitate bending along the primary traction axes A of those elements, however, elements 31 can deform substantially more than perimeter regions 30. In particular, elements 31 can deform so as to generally rest within a volume defined by perimeter regions 30 and surface S. This places more of the surface area of elements 31 into contact with surface S, but allows perimeter regions 30 to support much of the weight of the wearer of shoe 1. The traction of contact zone 9 is enhanced because of the better traction qualities of the soft elastomeric material relative to the hard elastomeric material, and the support provided by perimeter regions 30 reduces the wear on elements 31 that might otherwise occur.

Although the example of FIG. 8 assumes that forces on outsole 9 are parallel to the primary traction A axes of elements 31, similar deformations (and results) would occur when forces are not completely parallel to the primary traction axes A. For example, a wearer of shoe 1 might engage in a basketball play that results in a shear force across outsole 2 in direction C1 or in direction C2 shown in FIG. 1. A shear force in either of those directions would still have a significant component parallel to the A axes of the zone 9 traction elements. Accordingly, much of the traction available from deformation of those elements would still be provided, and the traction element wear would still be reduced.

Other contact zones of outsole 1 would function in a manner similar to that shown in FIG. 8 in response to shear forces parallel to the primary traction axes of traction elements in a particular zone.

The orientation of the traction elements within a particular zone can be chosen based on expected forces and motions that will be experienced during an activity for which a particular outsole is designed. For example, basketball shoe outsoles such as outsole 2 can include a large number of traction elements oriented in directions generally parallel to the outsole length so as to maximize traction in response to sideways forces. Tractions elements in zones 15 and 16 can be oriented generally transverse to outsole length so as to increase traction around the heel in response to rapid stopping maneuvers.

The traction element orientations of outsole 2 are merely one exemplary embodiment, however. In other embodiments, traction elements may be oriented differently. The shape, number, size and/or distribution of contact zones may vary in other embodiments. For example, outsoles according to other embodiments may include multi-material contact zones (i.e., contact zones with two or more elastomeric materials of differing hardness values) that cover less outsole surface than is the case with outsole 2. Dual- or other multi-material contact zones can have shapes and/or sizes other than as shown in FIGS. 1 and 3. Similarly, traction element sizes and shapes can also vary. Planar traction elements need not be trapezoidal and can have other shapes. Some traction elements can be thicker than other traction elements. For example, traction elements at the ends of an insert might be thinner that other traction elements of that insert. Some or all of the traction elements in a particular contact zone (or in multiple contact zones) may not extend outward beyond a perimeter of harder material.

Figure 9:
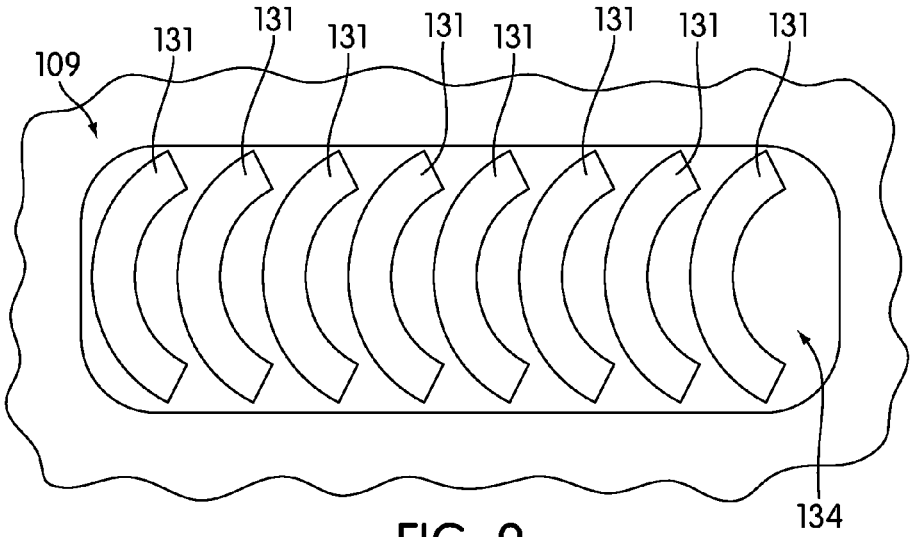
FIG. 9 is a bottom plan view of a portion of an outsole according to another embodiment.

Traction elements need not be planar. As but one example, FIG. 9 is bottom plan view of a contact zone 109 having multiple curved traction elements 131 in a cavity 134. Traction elements can have other non-planar shapes (e.g., compound curves, chevrons, etc.) All traction elements in a contact zone need not be parallel to one another. Traction elements need not have flat edges. For example, the outwardmost edge of a traction element that initially contacts a playing surface could be rounded. Traction elements need not be symmetric. Numerous other variations are possible.

Numerous additional variations are possible in still further embodiments. A perimeter of harder material surrounding traction elements of softer material need not be continuous. For example, perimeter regions could include bumps on exposed surfaces and/or grooves cut into exposed surfaces. Such grooves could be similar to grooves 64 and 65 shown in FIG. 4, or could be deeper and/or wider and/or more numerous. Perimeter regions may not completely surround a group of softer traction elements. As but one example, a cavity formed in a harder material may not be closed on all sides. As another example, a part of a cavity side may be open.

All traction elements within a particular contact zone need not be attached to a single insert. A traction element insert within a contact zone need not be homogenous. For example, a traction element insert could be formed from a heterogeneous material created by mixing materials with different hardness values, but with the mixture having an overall or average hardness less than that of material forming perimeter regions surrounding the heterogeneous insert. In a similar manner, perimeter regions could be formed from a heterogeneous material created by mixing materials with different hardness values, but with the resulting mixture having an overall or average hardness greater than that of a corresponding traction element insert.

In some embodiments, certain contact zones (e.g., in the forefoot regions) may include inserts formed from a first soft elastomeric material, and other contact zones (e.g., in the heel regions) may include inserts formed from a second soft elastomeric material. The first soft elastomeric material may be softer than the second soft elastomeric material, but both the first and second soft elastomeric materials may be softer than a hard elastomeric material used to form other portions of the outsole.

Figure 10:
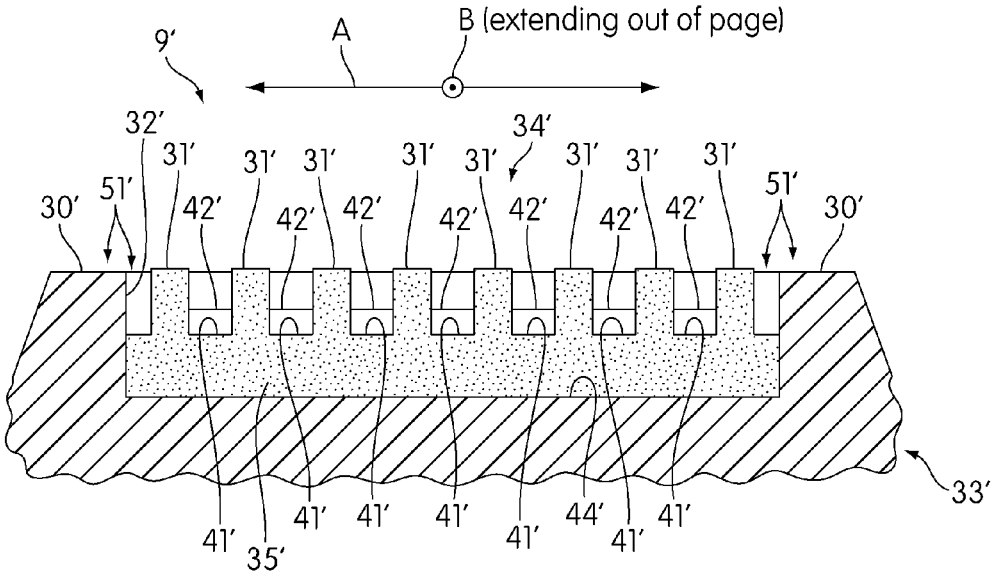
FIG. 10 a cross-sectional view an insert from a contact zone in another embodiment.

In some embodiments, some or all traction elements in an outsole may not extend significantly (or at all) beyond an exposed surface of a perimeter region when in an undeformed state. One example of this is shown in FIG. 10, a cross-sectional view an insert 34' from a contact zone 9' in such an embodiment. Except for the heights of traction elements discussed below, the outsole embodiment containing contact zone 9' may be otherwise similar to the embodiment exemplified by outsole 2 in FIGS. 1-8. Features in the embodiment of FIG. 10 may be structurally similar to features in FIGS. 1-8 having similar reference numbers. In particular, and except as otherwise described below, perimeter regions 30', traction elements 31', cavity 32', main body 33', insert 34', base 35', pockets 41', webs 42', inward surface 44' and exposed surfaces 51' in FIG. 10 may be respectively similar to perimeter regions 30, traction elements 31, cavity 32, main body 33, insert 34, base 35, pockets 41, webs 42 and exposed surfaces 51 described in connection with previous drawing figures.

As shown in FIG. 10, each of elements 31' terminates at a level that is approximately the same as that of exposed surface 51' of perimeter regions 30'. When subjected to a shear force, the traction elements of insert 34' rest within a volume defined by perimeter regions 30' and a playing surface such as surface S in FIG. 8. Although the traction elements of insert 34' may not deform as much as those of insert 34 shown in FIG. 8, the traction of contact zone 9' is still enhanced because of the better traction qualities of the soft elastomeric material relative to the hard elastomeric material, and the support provided by perimeter regions 30' reduces the wear on the traction elements of insert 34' that might otherwise occur. Some or all of the other contact zones in the outsole embodiment of FIG. 10 (e.g., zones similar to zones 8 and 10-23 of outsole 2) may also include inserts with traction elements having reduced height such as is shown in FIG. 10.

Figure 11A:
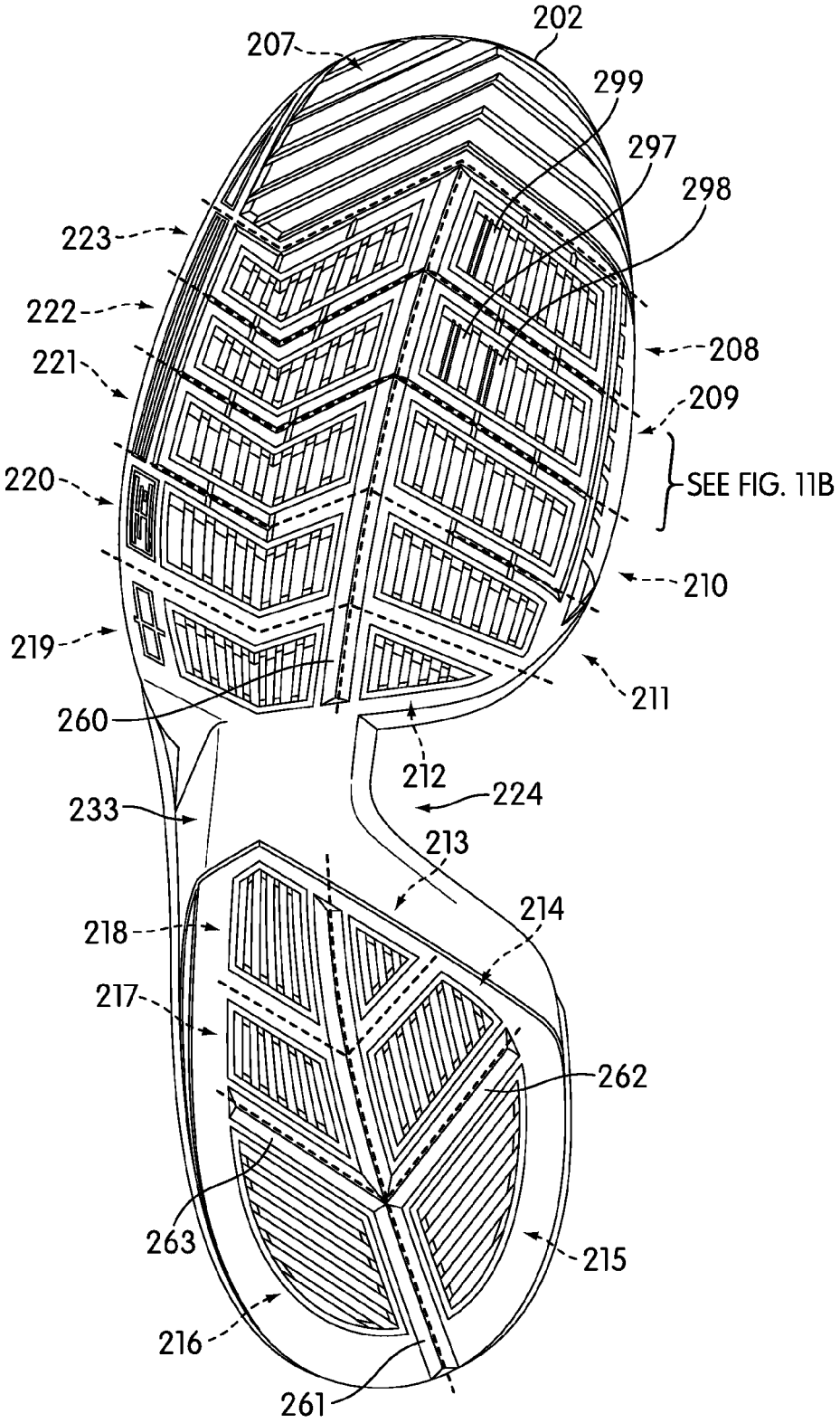
FIG. 11A is a bottom plan view of an outsole according to another embodiment.
Figure 11B:
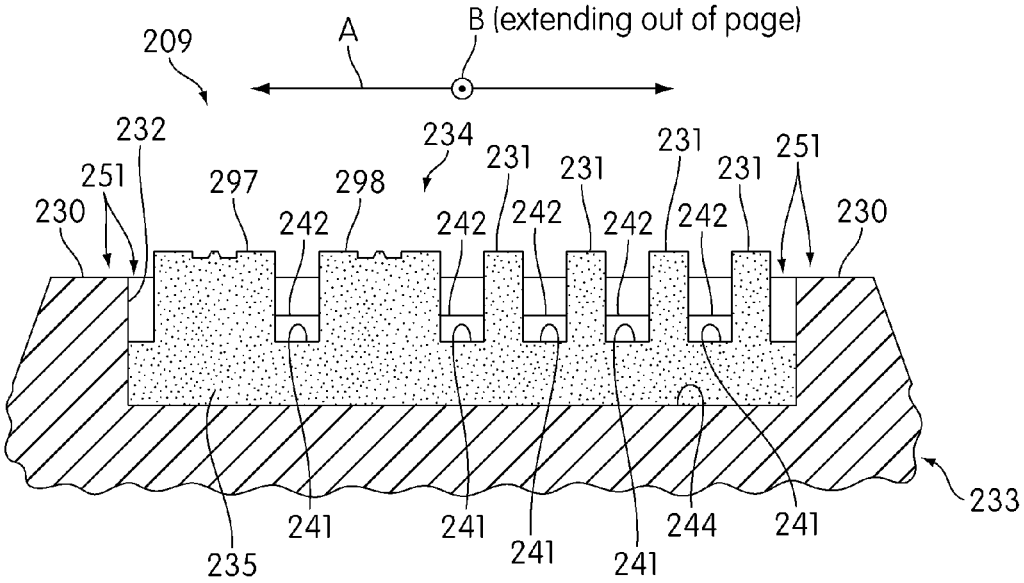
FIG. 11B is a cross-sectional view of a zone in the outsole of FIG. 11A.

During various athletic activities, a wearer may pivot an outsole about a point located in the forefoot region (e.g., under the ball of the wearer's foot). In some embodiments, the configuration of soft elastomeric inserts within certain contact zones is modified so as to further resist deformation and/or damage from such pivoting foot movements. FIG. 11A is a bottom plan view of an outsole 202 according to one such embodiment. FIG. 11B is a cross-sectional view of contact zone 209 taken from a location in contact zone 209 that is similar to the location from which the cross-sectional view of FIG. 5 was taken from contact zone 9 of FIG. 4. With the exception of certain features described below, outsole 202 may be otherwise similar or identical to outsole 2 of FIG. 3. Features in the embodiment of FIGS. 11A and 11B may be structurally similar to features in FIGS. 1-8 having similar reference numbers offset by 200. In particular, and except as otherwise described below, contact zones 207-223, arch region 224, flex grooves 260-263, perimeter regions 230, traction elements 231, cavity 232, main body 233, insert 234, base 235, pockets 241, webs 242, inward surface 244 and exposed surfaces 251 of FIGS. 11A and 11B may be respectively similar to contact zones 7-23, arch region 24, flex grooves 60-63, perimeter regions 30, traction elements 31, cavity 32, main body 33, insert 34, base 35, pockets 41, webs 42, inward surface 44 and exposed surfaces 51 of FIGS. 1-8.

Insert 234 of outsole 202 (FIG. 11B) differs from insert 34 of outsole 2 (FIG. 5) in one respect. In particular, two pairs of traction elements located near the center of outsole 202 have been replaced with thickened traction elements 297 and 298. In a similar manner, a pair of traction elements of the contact zone 208 insert (see FIG. 11A) has been replaced with a traction element 299 that is similar to elements 297 and 298. Elements 297-299 are located in regions of outsole 202 that are likely to experience significant twisting shear forces during pivotal foot movements. Those regions could be directly under (or near) the ball of the wearer's foot and/or the wearer's big toe (e.g., in regions corresponding to the distal end of a wearer's first metatarsal and/or to the first proximal phalanx and/or to the first distal phalanx). The thickened cross-sections of elements 297-299 allows those elements to resist tearing during such pivotal foot movements. In at least some embodiments, each of traction elements 297-298 has a thickness that is at least twice the thickness of other traction elements. In some such embodiments, each of elements 297-298 has a thickness approximately equal to the thicknesses of two tractions elements 231 plus the space between two adjacent elements 231.

Outsoles such as outsole 2 and according to other embodiments can be manufactured using minor variations of existing techniques. For example, the soft elastomeric inserts of an outsole (such as insert 34 of FIG. 5) can be formed in a first molding operation. After those inserts are formed, a mold plate can be removed to expose the base portions (e.g., base 35) of those inserts that will rest within body cavities (e.g., cavity 32) of the completed outsole. The removed mold plate can then be replaced with a second mold plate having a mold volume that corresponds to the hard elastomeric main body (e.g., main body 33) of the outsole and the main body molded in place around the soft elastomeric inserts.

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments discussed herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. References in the claims to characteristics of a physical element relative to a wearer of claimed article, or relative to an activity performable while the claimed article is worn, do not require actual wearing of the article or performance of the referenced activity in order to satisfy the claim.

The invention claimed is:

1. An article of footwear comprising:

an elastomeric outsole main body having a plurality of cavities defined therein, each of the cavities having interior side walls extending outward from a floor of the cavity lying between the interior side walls; and a plurality of elastomeric traction element inserts and wherein, as to each of the inserts, the insert is attached to the outsole within one of the cavities and is softer than the floor and interior side walls of the cavity in which the insert is attached, the insert includes a plurality of traction elements extending outwardly from the floor of the cavity in which the insert is attached, and the traction elements are separated from one another and from the interior side walls of the cavity in which the insert is attached so as to form a spacing between the traction elements and the interior side walls to permit the traction elements to significantly deform.

2. The article of footwear of claim 1, wherein a region of the outsole main body extending from an arch region to a toe region is substantially covered by the cavities.

3. The article of footwear of claim 2, wherein as to each of the inserts, the traction elements of the plurality are parallel to one another in an orientation direction, and the orientation direction is approximately parallel to a centerline of a forefoot region of the sole structure.

4. The article of footwear of claim 1, wherein a heel region of the outsole main body and a region of the outsole main body extending from an arch region to a toe region are substantially covered by the cavities.

5. The article of footwear of claim 4, wherein as to each of the inserts in the region of the outsole main body extending from the arch region to the toe region, the traction elements of the plurality are parallel to one another in an orientation direction, and the orientation direction is approximately parallel to a centerline of a forefoot region of the sole structure.

6. The article of footwear of claim 4, wherein the plurality of cavities includes at least 12 cavities, and each of the inserts includes at least 5 parallel traction elements.

7. The article of footwear of claim 6, wherein the outsole main body portions defining the cavities have a Shore A hardness value between about 68 and about 77, and the traction element inserts have a Shore A hardness value between about 42 and about 58.

8. The article of claim 1, wherein the traction elements are curved in a plantar plane.

9. The article of claim 1, wherein each of the inserts comprises a base from which the traction elements extend, the base covering the floor of the cavity in which the insert is attached.

10. An article of footwear comprising:

an outsole including a plurality of contact zones, each of the contact zones including elastomeric perimeter regions and a plurality of elastomeric traction elements and wherein, as to each of the contact zones, the traction elements of the plurality are softer than the perimeter regions, at least a portion of the perimeter regions for the contact zone define a traction element channel having a channel width defined by opposing interior side walls, each traction element of the plurality is generally planar, is a cantilever beam having a generally rectangular plantar plane corss section over most of its height, and substantially spans the width of the traction element channel, and the traction elements of the plurality are separated from each other and from the opposing interior side walls of the traction element channel so as to form a spacing between the traction elements and the interior side walls to permit the traction elements to significantly deform.

11. The article of footwear of claim 10, wherein a region of the outsole main body extending from an arch region to a toe region is substantially covered by the contact zones.

12. The article of footwear of claim 11, wherein as to each of the contact zones, the traction elements of the plurality are parallel to one another in an orientation direction, and the orientation direction is approximately parallel to a centerline of a forefoot region of the sole structure.

13. The article of footwear of claim 11, wherein, as to each of the contact zones, the traction elements of the plurality are parallel to one another and arranged in a row.

14. The article of footwear of claim 10, wherein a heel region of the outsole main body and a region of the outsole main body extending from an arch region to a toe region are substantially covered by the contact zones of the plurality.

15. The article of footwear of claim 14, wherein as to each of the contact zones in the region of the outsole main body extending from the arch region to the toe region, the traction elements of the plurality are parallel to one another in an orientation direction, and the orientation direction is approximately parallel to a centerline of a forefoot region of the sole structure.

16. The article of footwear of claim 15, wherein, as to each of the contact zones, the traction elements of the plurality are parallel to one another and arranged in a row.

17. The article of footwear of claim 10, wherein the plurality of contact zones includes at least 12 contact zones, and each of the contact zones includes at least 5 parallel traction elements.

18. The article of footwear of claim 17, wherein, for each of the plurality of contact zones, the perimeter regions have a Shore A hardness value between about 68 and about 77, and the traction elements have a Shore A hardness value between about 42 and about 58.

19. The article of footwear of claim 10, wherein, as to each of the contact zones, the traction element channel includes a floor lying between the opposing interior side walls, and the traction elements of the plurality are softer than the floor.

* * * * *